US009042769B2

(12) United States Patent
Yasui et al.

(10) Patent No.: US 9,042,769 B2
(45) Date of Patent: May 26, 2015

(54) DEVELOPING DEVICE, PROCESS CARTRIDGE, AND IMAGE FORMING APPARATUS

(71) Applicant: CANON KABUSHIKI KAISHA, Tokyo (JP)

(72) Inventors: Kojiro Yasui, Numazu (JP); Hiroki Ogino, Mishima (JP); Tomonori Mori, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/254,760

(22) Filed: Apr. 16, 2014

(65) Prior Publication Data

US 2014/0314439 A1 Oct. 23, 2014

(30) Foreign Application Priority Data

Apr. 23, 2013 (JP) ..... 2013-090802
Mar. 28, 2014 (JP) ..... 2014-069581

(51) Int. Cl.
*G03G 15/08* (2006.01)

(52) U.S. Cl.
CPC ..... *G03G 15/0898* (2013.01)

(58) Field of Classification Search
CPC ..... G03G 15/0817; G03G 15/0898; G03G 15/0812; G03G 15/0818; G03G 21/1832
USPC ..... 399/103
See application file for complete search history.

(56) References Cited

FOREIGN PATENT DOCUMENTS

| | | | |
|---|---|---|---|
| JP | 2000-356939 | A | 12/2000 |
| JP | 2003-186303 | A | 7/2003 |
| JP | 2004-163812 | A | 6/2004 |

OTHER PUBLICATIONS

Machine translation of Nishimura JP 2011-053325 A, publication date: Mar. 17, 2011.*

* cited by examiner

*Primary Examiner* — Walter L Lindsay, Jr.
*Assistant Examiner* — Frederick Wenderoth
(74) *Attorney, Agent, or Firm* — Canon U.S.A., Inc. IP Division

(57) ABSTRACT

A developing device includes a developer carrying member that carries developer; a frame member that supports the developer carrying member; a sealing section that faces a peripheral surface of the developer carrying member and suppresses leakage of the developer; and an interval ensuring member that maintains a distance between the image carrying member and the developer carrying member. The interval ensuring member includes a movement regulating portion that prevents movement of the interval ensuring member in a rotation direction of the developer carrying member when the image carrying member and the developer carrying member rotate, and a maintaining portion that contacts the image carrying member and the developer carrying member for maintaining the distance between the image carrying member and the developer carrying member. The maintaining portion and the sealing section are positioned in a predetermined cross section that is orthogonal to an axial line of the developer carrying member.

27 Claims, 16 Drawing Sheets

DEVELOPING DEVICE, PROCESS CARTRIDGE, AND IMAGE FORMING APPARATUS

BACKGROUND OF THE INVENTION

1. Field of the Invention

The present invention relates to an image forming apparatus, a developing device that is used in the image forming apparatus, and a process cartridge in which the developing device is integrated to an image carrying member.

Here, image forming apparatuses are, for example, apparatuses that form an image on a recording medium using an electrophotographic image forming system, and include an electrophotographic copying machine, an electrophotographic printer (such as a laser beam printer and an LED printer), and a word processor.

2. Description of the Related Art

Hitherto, in an image forming apparatus using an electrophotographic image forming process, a developing device is used as a device for developing a latent image on a photosensitive drum (image carrying member) using developer.

In this type of developing device, an interval ensuring member is provided at an end portion of a developing roller (developer carrying member) for regulating an interval between the photosensitive drum and the developing roller to a certain interval.

The interval ensuring member is interposed between the photosensitive drum and the developing roller by urging force of a spring or the like, and regulates the interval between the photosensitive drum and the developing roller to a certain interval on the basis of a wall thickness of the interval ensuring member.

The interval ensuring member maintains the distance between the photosensitive drum and the developing roller by contacting the photosensitive drum while rotating along with the developing roller in a rotation direction of the developing roller (refer to Japanese Patent Laid-Open No. 2000-356939 and Japanese Patent Laid-Open No. 2004-163812).

However, in the aforementioned related arts, the interval ensuring member rotates along a surface of the developer carrying member. Therefore, in a longitudinal direction, the interval ensuring member needs to be disposed outward from a developer sealing section in an axial direction (longitudinal direction) of the developer carrying member. This becomes a problem when performing size reduction in the axial direction (longitudinal direction) of the developer carrying member.

The term "sealing section" refers to a structure that suppresses (regulates) leakage of developer from a gap between an end portion of the developer carrying member and a frame member of the developing device by, for example, contacting the end portion of the developer carrying member (the details thereof are given later using, for example, FIG. 7).

SUMMARY OF THE INVENTION

The present invention provides a developing device, a process cartridge; and an image forming apparatus that, while maintaining developer sealing effect by a sealing section, has a simple structure and can be made compact in an axial direction of a developer carrying member.

Representative structures that are disclosed in the present application are as follows.

According to a first aspect of the present invention, there is provided a developing device that is used in an image forming apparatus. The developing device includes a developer carrying member that carries developer for developing a latent image on an image carrying member; a frame member that supports the developer carrying member; a sealing section that faces a peripheral surface of the developer carrying member and configured to suppress leakage of the developer from between an end portion of the developer carrying member and the frame member; and an interval ensuring member that maintains a distance between the image carrying member and the developer carrying member. The interval ensuring member includes a movement regulating portion that prevents movement of the interval ensuring member in a rotation direction of the developer carrying member when the image carrying member and the developer carrying member rotate, and a maintaining portion that contacts the image carrying member and the developer carrying member for maintaining the distance between the image carrying member and the developer carrying member. The maintaining portion and the sealing section are positioned in a predetermined cross section that is orthogonal to an axial line of the developer carrying member.

According to a second aspect of the present invention, there is provided another developing device that is used in an image forming apparatus. The developing device includes a developer carrying member that carries developer for developing a latent image on an image carrying member; a frame member that supports the developer carrying member; a sealing section that faces a peripheral surface of the developer carrying member and configured to regulate leakage of the developer from between an end portion of the developer carrying member and the frame member; and an interval ensuring member that is positioned between the image carrying member and the developer carrying member and that maintains a distance between the image carrying member and the developer carrying member. The interval ensuring member is prevented from moving in a rotation direction of the developer carrying member. The interval ensuring member and the sealing section are positioned in a predetermined cross section that is orthogonal to an axial line of the developer carrying member. A region that allows the sealing section to face the developer carrying member without the interval ensuring member being interposed therebetween is provided in the cross section.

According to a third aspect of the present invention, there is provided a process cartridge that is attachable to and detachable from a main body of an image forming apparatus. The process cartridge includes an image carrying member on which a latent image is formed; a developer carrying member that carries developer for developing a latent image on the image carrying member; a frame member that supports the developer carrying member; a sealing section that faces a peripheral surface of the developer carrying member and configured to suppress leakage of the developer from between an end portion of the developer carrying member and the frame member; and an interval ensuring member that maintains a distance between the image carrying member and the developer carrying member. The interval ensuring member includes a movement regulating portion that prevents movement of the interval ensuring member in a rotation direction of the developer carrying member when the image carrying member and the developer carrying member rotate, and a maintaining portion that contacts the image carrying member and the developer carrying member for maintaining the distance between the image carrying member and the developer carrying member. The maintaining portion and the sealing section are positioned in a predetermined cross section that is orthogonal to an axial line of the developer carrying member.

According to a fourth aspect of the present invention, there is provided another process cartridge that is attachable to and detachable from a main body of an image forming apparatus. The process cartridge includes an image carrying member on which a latent image is formed; a developer carrying member that carries developer for developing a latent image on the image carrying member; a frame member that supports the developer carrying member; a sealing section that faces a peripheral surface of the developer carrying member and configured to regulate leakage of the developer from between an end portion of the developer carrying member and the frame member; and an interval ensuring member that is positioned between the image carrying member and the developer carrying member and that maintains a distance between the image carrying member and the developer carrying member. The interval ensuring member is prevented from moving in a rotation direction of the developer carrying member. The interval ensuring member and the sealing section are positioned in a predetermined cross section that is orthogonal to an axial line of the developer carrying member. A region that allows the sealing section to face the developer carrying member without the interval ensuring member being interposed therebetween is provided in the cross section.

According to a fifth aspect of the present invention, there is provided a image forming apparatus that forms an image on a recording medium. The image forming apparatus includes an image carrying member on which a latent image is formed; a developer carrying member that carries developer for developing a latent image on the image carrying member; a frame member that supports the developer carrying member; a sealing section that faces a peripheral surface of the developer carrying member and configured to suppress leakage of the developer from between an end portion of the developer carrying member and the frame member; an interval ensuring member that maintains a distance between the image carrying member and the developer carrying member; and a transport mechanism that transports the recording medium. The interval ensuring member includes a movement regulating portion that prevents movement of the interval ensuring member in a rotation direction of the developer carrying member when the image carrying member and the developer carrying member rotate, and a maintaining portion that contacts the image carrying member and the developer carrying member for maintaining the distance between the image carrying member and the developer carrying member. The maintaining portion and the sealing section are positioned in a predetermined cross section that is orthogonal to an axial line of the developer carrying member.

Further features of the present invention will become apparent from the following description of exemplary embodiments with reference to the attached drawings.

DESCRIPTION OF THE EMBODIMENTS

First Exemplary Embodiment

Exemplary embodiments of the present invention are described in detail below with reference to the drawings. Unless specifically stated, the scope of the invention is not limited to dimensions, materials, shapes, relative arrangements, etc., of structural components that are described in the exemplary embodiments. In the description below, as regards members that have been described once, their materials, shapes, etc. are regarded as being the same as those in the initial description unless they are described anew.

Unless specifically stated, the term "longitudinal direction" refers to an axial direction of a developing roller (developer carrying member), that is, a direction that is parallel to the direction in which the axial line of the developing roller extends.

Description of Entire Electrophotographic Image Forming Apparatus

Figure 2:
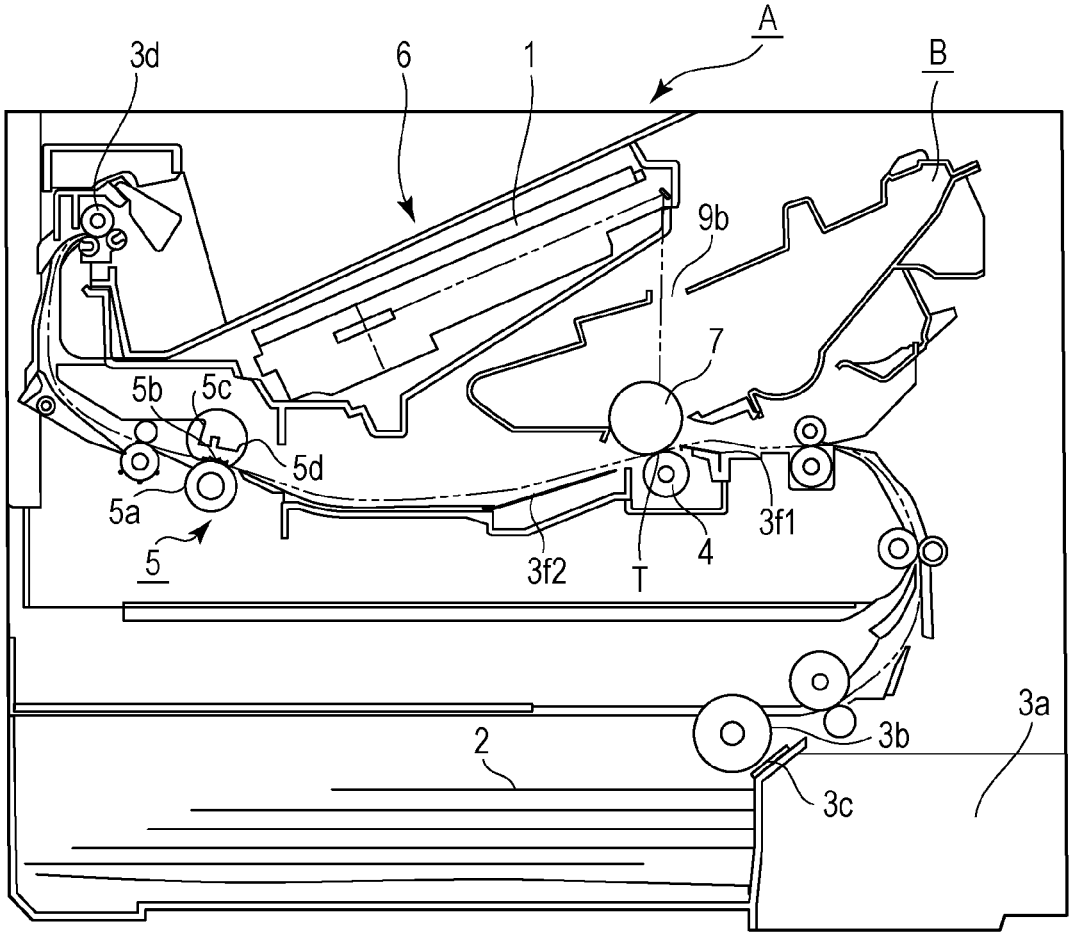
FIG. 2 is a sectional view of a structure of an image forming apparatus.

First, the entire structure of an electrophotographic image forming apparatus A (hereunder referred to as "image forming apparatus") is schematically described with reference to FIG. 2. FIG. 2 is a schematic sectional view of the image forming apparatus A on which a process cartridge B according to an exemplary embodiment is mounted. More specifically, FIG. 2 is a schematic sectional view of a laser beam printer, which is one form of an image forming apparatus.

As shown in FIG. 2, the image forming apparatus (laser beam printer) A according to the exemplary embodiment irradiates a photosensitive drum 7 with information light based on image information from an optical system 1 serving as an optical unit, and forms a latent image (electrostatic latent image) on the photosensitive drum 7. The electrostatic latent image is developed with developer, so that a developer image is formed. The photosensitive drum 7 is an image carrying member.

In synchronism with the formation of the developer image, recording media (such as recording paper, overhead projector (OHP) sheets, and cloth) 2 are separated and fed one by one by a pickup roller 3*b* and a press-contact member 3*c*, which press-contacts the pickup roller 3*b*, from a cassette 3*a*.

The fed recording medium 2 is transported along a transport guide 3*f*1 to a transfer section T where a transfer roller 4, serving as a transfer unit, and the photosensitive drum 7 of the process cartridge B oppose each other.

The recording medium 2 that has been transferred to the transfer section T is such that the developer image formed on the photosensitive drum 7 is transferred to this recording medium 2 by the transfer roller 4 to which a voltage has been applied. Then, the recording medium 2 is transported along a transport guide 3*f*2 to a fixing unit 5.

The fixing unit 5 includes a driving roller 5*a*, a heater 5*b*, and a fixing rotary member 5*d* formed from a cylindrical sheet rotatably supported by a support member 5*c*. The fixing unit 5 applies heat and pressure to the recording medium 2 that passes through the fixing unit 5, and fixes the transferred developer image.

A discharge roller 3*d* is configured to transport the recording medium 2 to which the developer image has been fixed, and discharges the recording medium 2 to a discharge section 6 via a reversal transport path. In the exemplary embodiment, the pickup roller 3*b*, the press-contact member 3*c*, the discharge roller 3*d*, etc., form a transport unit (transport device, transport mechanism) 3 that transports the recording medium 2.

Process Cartridge

Figure 3:
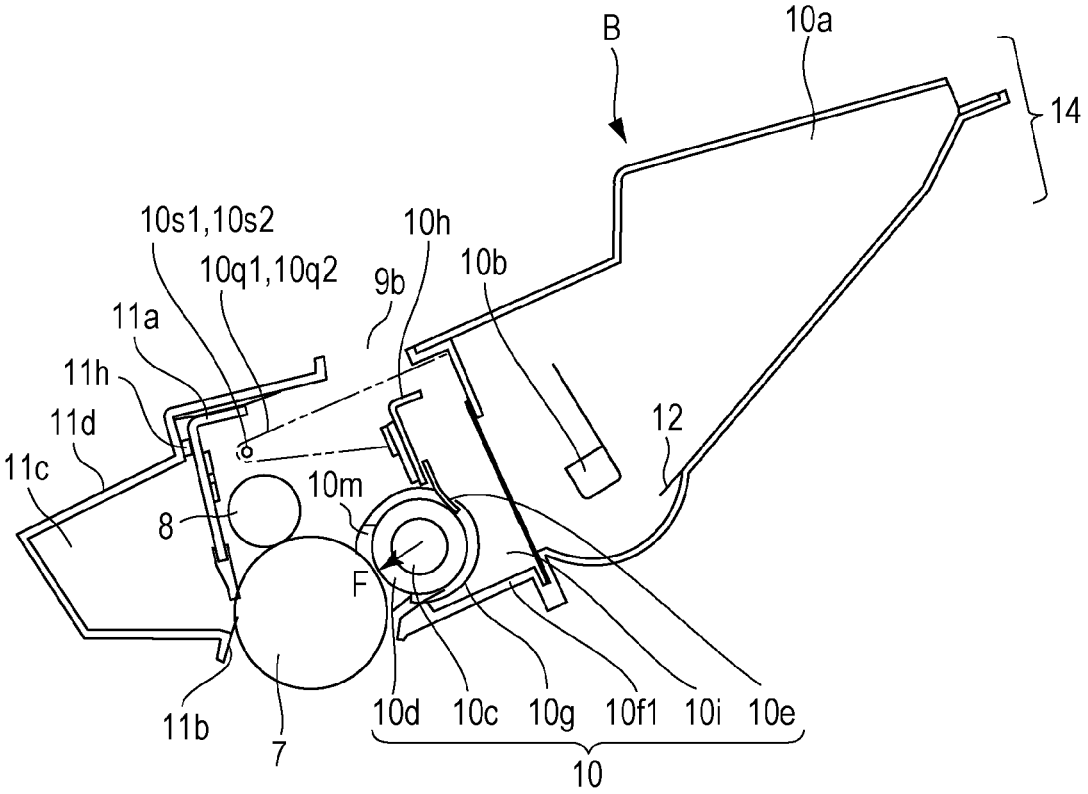
FIG. 3 is a sectional view of a process cartridge.

Next, the entire structure of the process cartridge B is schematically described with reference to FIGS. 2, 3, and 6. FIG. 3 is a schematic sectional view of the process cartridge B according to the exemplary embodiment.

As shown in FIG. 3, the process cartridge B includes at least the photosensitive drum 7 and a developing unit 10. As a process unit, it may also include, for example, a charging unit 8 that charges the photosensitive drum 7 and a cleaning unit 11*a* for cleaning off any residual developer on the photosensitive drum 7.

The process cartridge B according to the exemplary embodiment includes a drum unit 11 that rotatably supports the photosensitive drum 7 and that includes, for example, a cleaning blade 11*a* and a drum frame member 11*d* having built therein the charging roller 8. In addition, the process cartridge B includes the developing unit 10 including, for example, a developing roller 10*d* and a developing frame member 10*f*1 that rotatably supports the developing roller 10*d*. The process cartridge B includes the drum unit 11 and the developing unit 10.

The developing roller 10*d* is a developer carrying member that carries developer. The developing unit 10 is a developing device for developing a latent image on the photosensitive drum 7. In the exemplary embodiment, the developing device forms part of the process cartridge B, and is attachable to and detachable from a main body of the image forming apparatus A. Along with a developer frame member 14 (described below), the developing frame member 10*f*1 forms a frame member of the developing device. The frame member of the developing unit 10 is a member that supports and secures each member (such as the developing roller 10*d*) of the developing unit 10, and accommodates developer (toner). In the exemplary embodiment, of the frame member of the developing unit 10, the developing frame member 10*f*1 supports the developing roller 10*d*, and the developer frame member 14 forms a developer chamber 10*a* that accommodates developer.

The process cartridge B according to the exemplary embodiment is such that the photosensitive drum 7 including a photosensitive layer rotates and the charging roller 8, serving as a charging unit, uniformly charges the surface of the photosensitive drum 7 as a result of applying a voltage to the charging roller 8. As shown in FIG. 2, the image forming apparatus is formed so that the charged photosensitive drum 7 is exposed to information light (light image), which is based on image information, from the optical system 1 via an exposure opening 9*b* to form an electrostatic latent image on the surface of the photosensitive drum 7 and develop the electrostatic latent image by the developing unit 10.

The developing unit 10 sends out developer in the developer chamber 10*a*, serving as a developer accommodation section, of the developer frame member 14 to a developing chamber 10*i* by a developer transport member (hereunder referred to as "developer feeding member") 10*b* and an elastic sheet 12. The elastic sheet 12 is a member that is disposed in a region of rotation of the developer feeding member 10*b*, and that moves the developer towards the developing chamber 10*i* by contacting the developer feeding member 10*b* and vibrating.

The developing roller 10*d* having a stationary magnet 10*c* built therein is rotated, and a developer layer to which a triboelectric charge is applied by a developing blade 10*e*, serving as a developer regulating member, is formed on the surface of the developing roller 10*d*. By transferring the developer to the photosensitive drum 7 in accordance with the electrostatic latent image, a developer image is formed, so that the electrostatic latent image is formed into a visible image.

Figure 6:
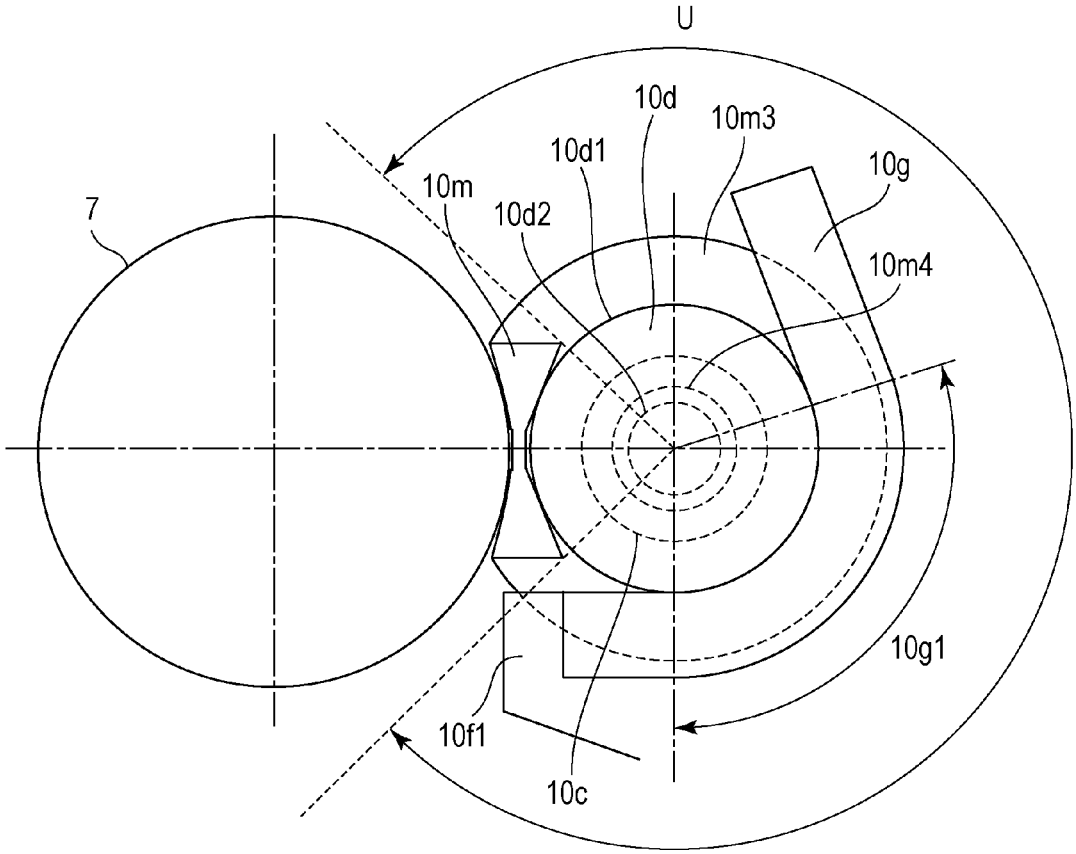
FIG. 6 is a sectional view of the structure of the interval ensuring member.

Further, as shown in FIGS. 3, 6, and 7, at two end portions of the developing roller 10*d*, a sealing member 10*g* that prevents leakage of developer from a gap between each end portion of the developing roller 10*d* and the developing frame member 10*f*1 is mounted on the developing frame member 10*f*1.

Figure 7A:
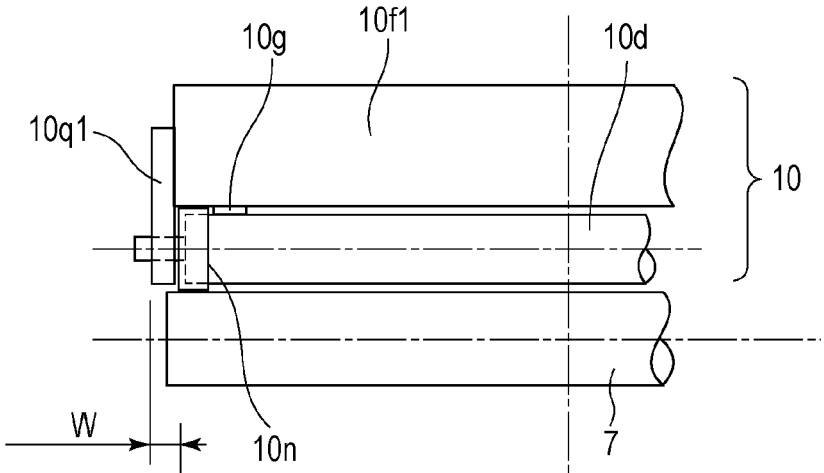
FIGS. 7A and 7B are explanatory views for comparing longitudinal dimensions in an exemplary embodiment and longitudinal dimensions in a related art.
Figure 7B:
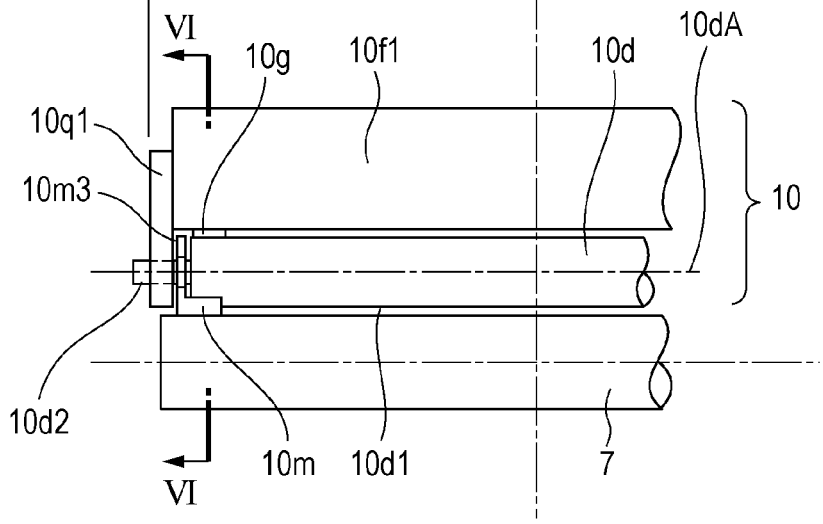

As shown in FIGS. 3, 6, and 7B, the sealing member 10*g* is provided with a developer sealing surface 10*g*1 for suppressing (regulating) leakage of developer from the gap between the developing roller 10*d* and the developing frame member 10*f*1 in the longitudinal direction of the developing roller 10*d*. The developer sealing surface 10*g*1 is provided in a region where a surface of the sealing member 10*g* and the surface of the developing roller 10*d* oppose each other. The term "developer sealing surface 10*g*1" refers to a developer sealing section (hereunder simply referred to as "sealing section") among portions of the sealing member 10*g*. The sealing section suppresses leakage of developer.

The sealing member 10*g* is formed of, for example, unwoven cloth or a pile, formed of fiber such as Teflon (trade name), nylon, or the like. The sealing member 10*g* stops leakage of the developer by contacting the surface of the developing roller 10*d* when the developing roller 10*d* is stopped and by rubbing against the surface of the developing roller when the developing roller 10*d* is rotating. That is, by causing the developer sealing surface 10*g* to contact a peripheral surface of the developing roller 10*d*, the sealing member 10*g* fills a gap formed between the end portions of the developing roller 10*d* and the developing frame member 10*f*1. This prevents the developer from leaking out of the developing unit 10 from the gap formed between the end portions of the developing roller 10*d* and the developing frame member 10*f*1.

Figure 8:
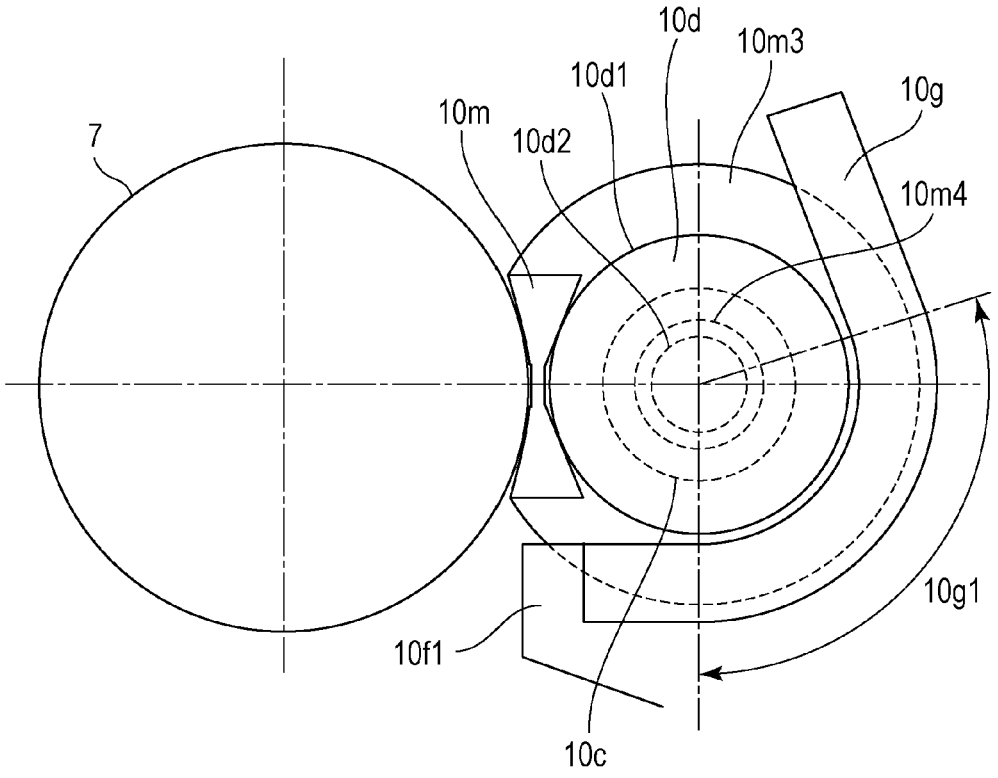
FIG. 8 is a sectional view of the structure of the interval ensuring member.

When the developer includes a magnetic material, the sealing member 10*g* may be formed of a magnetic material having magnetic force. As shown in FIG. 8, the sealing member 10*g* is disposed apart from the developing roller 10*d* at a predetermined distance.

The developer is sealed in by a magnetic field that is generated between the sealing member 10*g* and the stationary magnetic 10*c* built in the developing roller 10*d*. That is, the developer is captured by the magnetic field that is generated between the stationary magnet 10*c* and the sealing member 10*g*, so that the developer does not move to the outside of (does not leak to the outside from) the developing device.

Accordingly, when the sealing member 10*g* using magnetic force is used, a magnetic field is generated between the sealing member 10*g* and the developing roller 10*d*, so that the region of the sealing member 10*g* that seals in the developer becomes the developer sealing surface (sealing section) 10*g*1.

As shown in FIG. 7B, the sealing member 10*g* is disposed at the end portions of the developing roller 10*d* in a longitudinal direction.

After transferring the developer image to the recording medium 2 by applying a voltage having a polarity that is opposite to that of the developer image to the transfer roller 4, the cleaning blade 11*a* scrapes off residual developer on the photosensitive drum 7. The developer that has been scraped off by the cleaning blade 11*a* is scooped up by a recovery sheet 11*b*, and is collected by a removed developer accommodating section 11*c*.

Next, as shown in FIGS. 3 and 7, the developing frame member 10*f*1 is provided with bearings 10*q*1 and 10*q*2, which rotatably support the developing roller 10*d*. In the exemplary embodiment, the bearings 10*q*1 and 10*q*2 include connection holes 10*s*1 and 10*s*2 for rotatably supporting the developing unit 10 including the developing roller 10*d* by the drum unit 11 including the cleaning blade 11*a*.

Pins (not shown) are provided in the connection holes 10*s*1 and 10*s*2 so as to rotatably support the drum unit.

Although the connection holes 10*s*1 and 10*s*2 are formed in the bearings 10*q*1 and 10*q*2, they may be formed in different members (not shown).

This structure makes it possible for the developing frame member 10*f*1 to move relative to the developing roller 10*d*. Further, by providing a spring (not shown) between the developing unit 10 and the drum unit 11, a predetermined force f is applied to a location between the developing unit 10 and the drum unit 11, to urge the developing roller 10*d* towards the photosensitive drum 7.

An interval ensuring member 10*m* that maintains the interval between the developing roller 10*d* and the photosensitive drum 7 is disposed on both end portions in a longitudinal direction of the developing roller 10*d*.

Interval Ensuring Member That Maintains Interval Between Developing Roller and Photosensitive Drum Next, a structure of the interval ensuring member 10*m* that maintains the distance between the developing roller and the photosensitive drum (that is, the interval between the surface of the developing roller 10*d* and the surface of the photosensitive drum 7 in the exemplary embodiment) is described in detail with reference to FIGS. 1, 4, 6, and 7.

First, as shown in FIGS. 6 and 7B, the developing roller 10*d* includes a large diameter portion 10*d*1 that contacts the interval ensuring member 10*m* and maintains the interval between the developing roller 10*d* and the photosensitive drum 7. The developing roller 10*d* also includes a small diameter portion 10*d*2 that is disposed outward from the large diameter portion 10*d*1 in a longitudinal direction thereof and that is thinner than the large diameter portion 10*d*1. The small diameter portion 10*d*2 is disposed substantially coaxially with the large diameter portion 10*d*1. The large diameter portion 10*d*1 of the developing roller 10*d* is a portion that carries developer on its surface (developer carrying region). The small diameter portion 10*d*2 is a shaft that is supported by the aforementioned bearings 10*q*1 and 10*q*2.

FIG. 6 is a sectional view that is orthogonal to an axial line 10*d*A of the developing roller 10*d*, and is a sectional view taken along arrows VI-VI in FIG. 7B.

The interval ensuring member 10*m* is formed of polyacetal and formed by injection molding. However, the material of the interval ensuring member 10*m* may be selected from, for example, polyethersulfone, polyphenylene sulfide, nylon, and other types of resin as appropriate.

Figure 1:
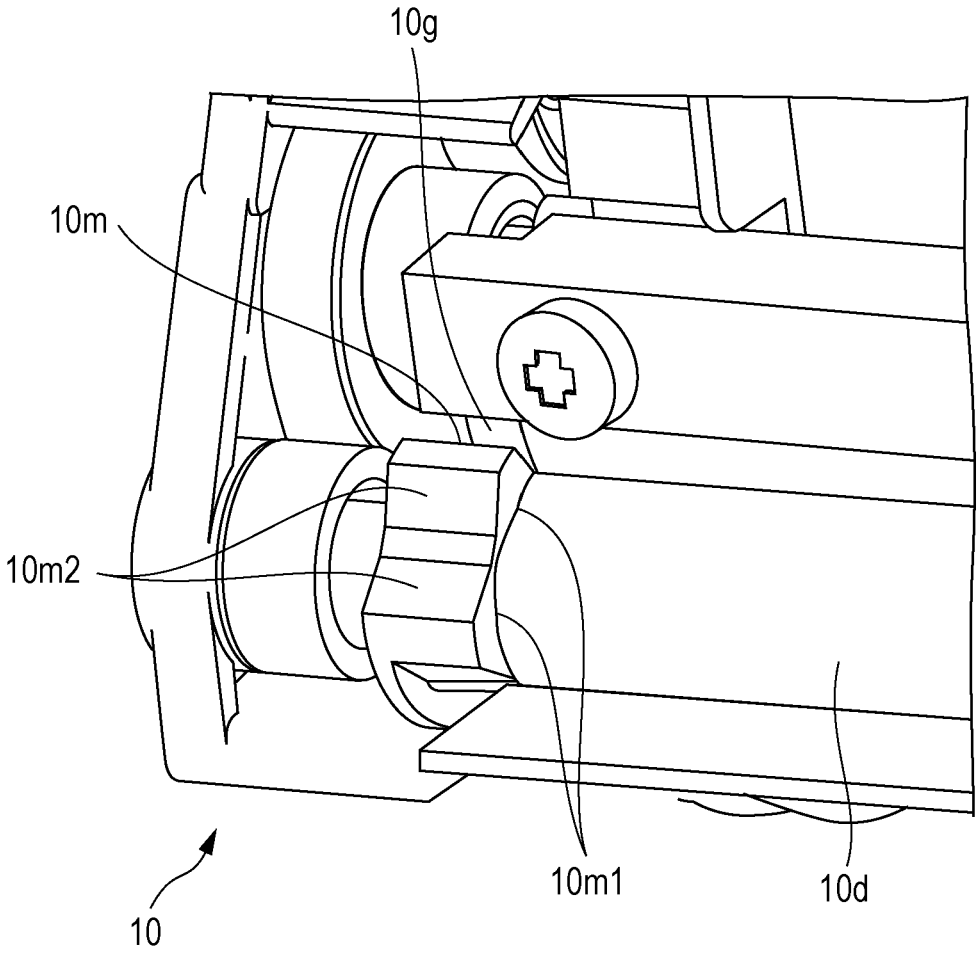
FIG. 1 is an explanatory view of a structure of an interval ensuring member.
Figure 4:
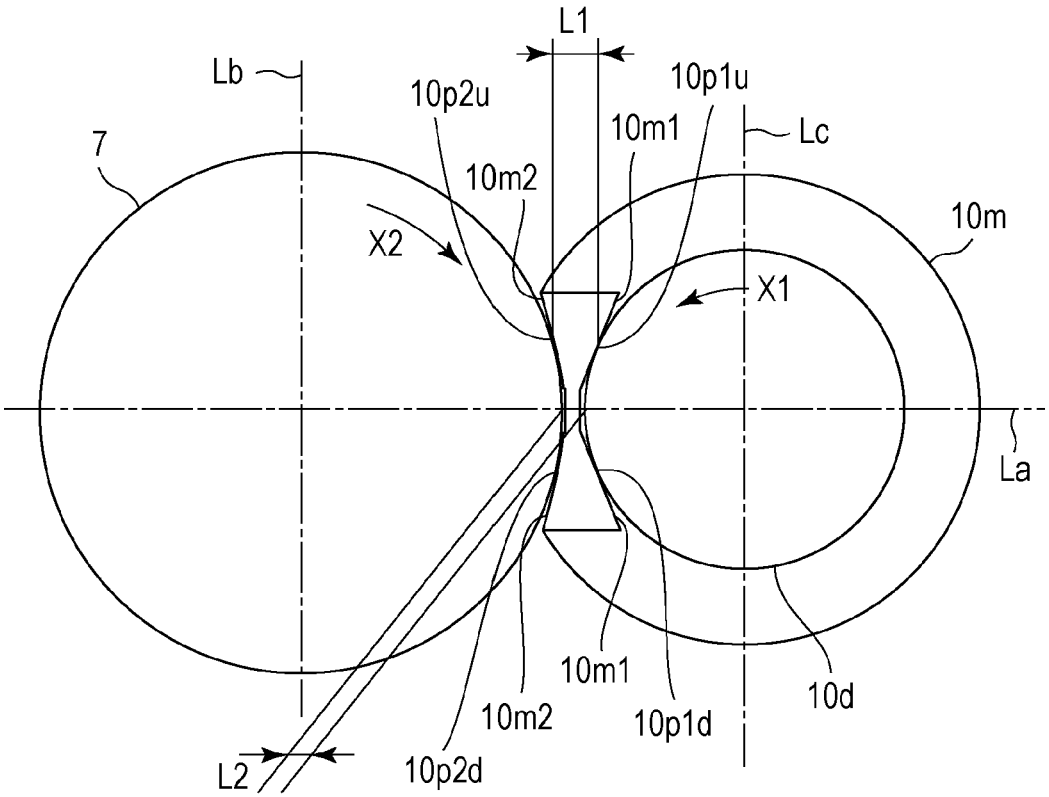
FIG. 4 is a sectional view of the structure of the interval ensuring member.

As shown in FIGS. 1 and 4, the interval ensuring member 10*m* includes a developing roller contact surface 10*m*1 extending along the developing roller 10*d* and a photosensitive drum contact surface 10*m*2 extending along the photosensitive drum 7.

As shown in FIG. 4, in the exemplary embodiment, although the contact surfaces 10*m*1 and 10*m*2 are planar surfaces, they need not be planar surfaces. They may also be curved surfaces.

As shown in FIGS. 1, 6, and 7B, the contact surface 10*m*1 of the interval ensuring member 10*m* that contacts the developing roller 10*d* is disposed along the longitudinal direction of the developing roller 10*d* in a region at the developing-roller large diameter portion 10*d*1 opposing the sealing member 10*g*.

As shown in FIG. 4, two developing-roller contact portions 10*p*1 are disposed, one on each side of a line (straight line) La connecting a rotation center of the photosensitive drum 7 and a rotation center of the developing roller 10*d*. In addition, two photosensitive-drum contact portions 10*p*2 are disposed, one on each side of the line La. Accordingly, there are a total of four contact portions.

As regards the line La, when the photosensitive drum 7 and the developing roller 10*d* are not aligned in a peripheral direction, the following is assumed. Within a range in which the interval ensuring member 10*m* contacts the photosensitive drum 7 and the developing roller 10*d* in the longitudinal direction of the developing roller 10*d*, a line that connects the rotation center of the photosensitive drum 7 and a chosen rotation center of the developing roller 10*d* in a cross section at a chosen position in a longitudinal direction is defined as the line La.

Further, the photosensitive-drum contact portions 10*p*2*u* and 10*p*2*d* are provided at the side of the developing roller 10*d* with respect to a line Lb that is perpendicular to the line La passing through the rotation center of the photosensitive drum 7.

The developing-roller contact portions 10*p*1*u* and 10*p*1*d* are provided at the side of the photosensitive drum 7 with respect to a line Lc that is perpendicular to the line La passing through the center of the developing roller 10*d*.

A distance L1 between the photosensitive-drum contact portion 10*p*2*u*, which is disposed upstream from the line La in a rotation direction of the photosensitive drum, and the developing-roller contact portion 10*p*1*u*, which is disposed upstream from the line La in a rotation direction of the developing roller, is longer than a distance L2 between closest portions of the photosensitive drum 7 and the developing roller 10*d*. Here, the distance L1 is a distance that is measured in a direction parallel to the line La.

Next, the operation of ensuring the interval between the photosensitive drum 7 and the developing roller 10*d* is described.

Here, as mentioned above, the photosensitive drum 7 and the developing roller 10*d* are movable relative to each other. A predetermined pressure is applied to a location between the developing unit 10 and the drum unit 11, so that the photosensitive drum 7 and the developing roller 10*d* are urged towards each other.

As shown in FIG. 4, the pressure causes the interval ensuring member 10*m* to contact the large diameter portion 10*d*1 of the developing roller 10*d* at two locations, that is, at the developing-roller contact portions 10*p*1*u* and 10*p*1*d* of the developing-roller contact surface 10*m*1. In addition, the pressure also causes the interval ensuring member 10*m* to contact the surface of the photosensitive drum 7 at two locations, that is, at the photosensitive-drum contact portions 10*p*2*u* and 10*p*2*d* of the photosensitive-drum contact surface 10*m*2. This causes the interval between the developing roller 10*d* and the photosensitive drum 7 to be maintained at a certain interval.

When forming an image, the contact portions of the interval ensuring member 10*m* for the developing roller 10*d* and the photosensitive drum 7 rub against the developing roller 10*d* or the photosensitive drum 7, so that the interval between the developing roller 10*d* and the photosensitive drum 7 is maintained. That is, when the photosensitive-drum contact portions 10*p*2*u* and 10*p*2*d* contact the photosensitive drum 7 and the developing-roller contact portions 10*p*1*u* and 10*p*1*d* contact the developing roller 10*d*, maintaining portions that maintain the distance between the developing roller 10*d* and the photosensitive drum 7 are formed.

Next, a rotation prevention operation of the interval ensuring member 10*m* is described. The photosensitive-drum contact portion 10*p*2*u* and the developing-roller contact portion 10*p*1*u* are movement regulating portions of the interval ensuring member 10*m*. When the photosensitive-drum contact portion 10*p*2*u* and the developing-roller contact portion 10*p*1*u* contact the photosensitive drum 7 and the developing roller 10*d*, respectively, the interval ensuring member 10*m* is prevented from moving in the direction of rotation of the photosensitive drum 7 and in the rotation direction of the developing roller 10*d*.

The interval ensuring member 10*m* sets the distance L1 between the photosensitive-drum contact portion 10*p*2*u* and the developing-roller contact portion 10*p*1*u*, serving as movement regulating portions, longer than the distance L2 between the closest portions of the photosensitive drum 7 and the developing roller 10*d* (that is, the shortest distance between the surface of the photosensitive drum and the surface of the developing roller).

As shown in FIGS. 3 and 4, when forming an image, the developing roller 10*d* and the photosensitive drum 7 rotate in directions X1 and X2, and pressure F is applied to the developing roller 10*d* and the photosensitive drum 7. The directions X1 and X2 are directions of movement in which peripheral surfaces (opposing surfaces) of opposing portions of the developing roller 10*d* and the photosensitive drum 7 move in the same direction.

Accordingly, even if the developing roller 10*d* and the photosensitive drum 7 are rotated when forming an image, the interval ensuring member 10*m* does not rotate. That is, the interval ensuring member 10*m* is prevented from moving in the rotation direction of the developing roller 10*d* and the rotation direction of the photosensitive drum 7.

As described above, the interval ensuring member 10*m* is regulated in the rotation direction by contacting the photosensitive drum 7. The structural members other than the photosensitive drum 7 are not required to regulate the interval ensuring member 10*m* in the rotation direction.

An existing interval ensuring member 10*n* that rotates and that is shown in FIG. 7A is not capable of preventing developer from entering a gap between the interval ensuring member 10*n* and the developing roller 10*d*. The interval between the photosensitive drum 7 and the developing roller 10*d* may become changeable due to the developer that has entered the gap. However, the interval ensuring member 10*m* according to the present invention is unrotatable, so that the contact portion 10*p*1*u* that contacts the surface of the developing roller 10*d* at an uppermost stream side of the developing roller 10*d* in the rotation direction thereof holds back the developer. That is, the contact portion 10*p*1*u* is capable of holding back the developer.

This makes it possible to stably maintain the gap between the photosensitive drum 7 and the developing roller 10*d* without reducing the interval between the interval ensuring member 10*m* and the developing roller 10*d*.

Next, the structure and operation for positioning the interval ensuring member 10*m* in the longitudinal direction thereof are described. As shown in FIGS. 1, 5, 6, and 7B, the interval ensuring member 10*m* includes a longitudinal movement regulating portion (longitudinal regulating portion) 10*m*3 that is disposed at a portion of the interval ensuring member 10*m* at the outer side of the developing roller 10*d* in the longitudinal direction thereof and that has a hole 10*m*4 through which a small-diameter shaft 10*d*2 of the developing roller 10*d* extends.

As shown in FIG. 6, with the interval ensuring member 10*m* being positioned by the photosensitive drum 7 and the developing roller 10*d*, a wall of the through hole 10*m*4 does not contact the small-diameter shaft 10*d*2 of the developing roller 10*d* that extends through the through hole 10*m*4. In order to achieve this, the inside diameter of the through hole 10*m*4 is larger than the diameter of the small-diameter shaft 10*d*2 of the developing roller.

Therefore, while the interval ensuring member 10*m* maintains the interval between the photosensitive drum 7 and the developing roller 10*d*, the wall of the through hole 10*m*4 and the small-diameter shaft 10*d*2 of the developing roller 10*d* do not interfere with each other. The interval ensuring member 10*m* is capable of properly maintaining the interval between the photosensitive drum 7 and the developing roller 10*d*.

As shown in FIG. 7B, the longitudinal movement regulating portion 10*m*3 of the interval ensuring member 10*m* is disposed between the bearing 10*q*1 and a stepped surface formed by the small-diameter portion 10*d*2 and the large-diameter portion 10*d*1 of the developing roller 10*d*, so that positioning in a longitudinal direction can be performed. That is, the longitudinal movement regulating portion 10*m*3 is interposed between the bearing 10*q*1 of the developing frame member 10*f*1 and a side surface of the large-diameter portion 10*d*1 of the developing roller 10*d*, so that the longitudinal movement regulating portion 10*m*3 prevents the longitudinal movement of the interval ensuring member 10*m*.

The bearing 10*q*1 is a second longitudinal movement regulating portion (longitudinal regulating portion) that is provided at the developing frame member 10*f*1. The large-diameter portion 10*d*1 is a third longitudinal movement regulating portion (longitudinal regulating portion) that is provided at the developing roller 10.

Figure 5:
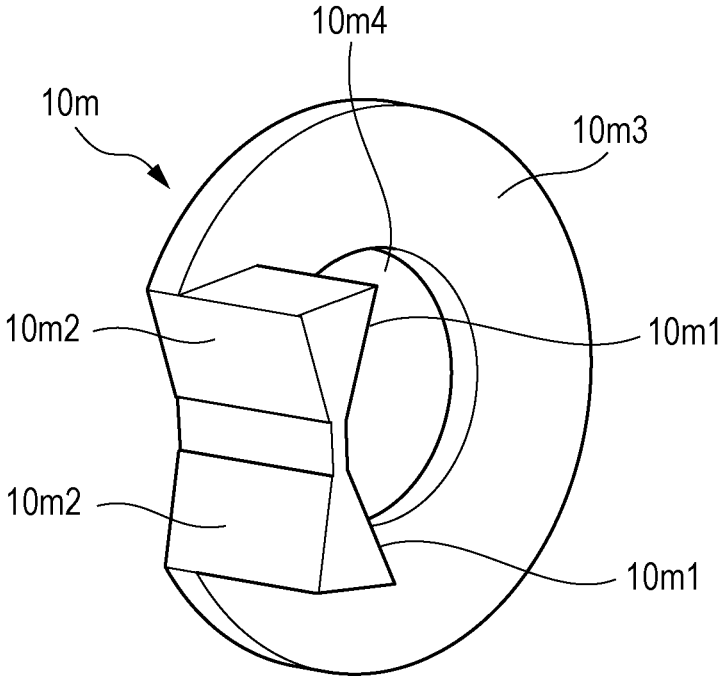
FIG. 5 is a perspective view of the structure of the interval ensuring member.

Next, with reference to FIGS. 5 and 7, a longitudinal arrangement of the interval ensuring member 10*m*, which is a main portion according to the present invention, is described by comparing it with a related art.

As shown in FIG. 7A, the existing interval ensuring member 10*n* is formed so as to rotate coaxially with the developing roller 10*d*. Therefore, when an attempt is made to place the existing interval ensuring member 10*n* and the sealing member 10*g* so as to overlap each other in the longitudinal direction, the interval ensuring member 10*n* is interposed between the developing roller 10*d* and the developer sealing surface 10*g*1 of the sealing member 10*g*. This prevents sealability (capability of preventing leakage of developer) from being provided between the interval ensuring member 10*n* and the developing roller 10*d*.

Therefore, hitherto, the sealing member 10*g* and the interval ensuring member 10*n* have been disposed so as not to overlap each other, that is, so as to be completely displaced from each other in the longitudinal direction.

In contrast to this, the interval ensuring member 10*m* according to the exemplary embodiment does not rotate coaxially with the developing roller. That is, even if the developing roller rotates, the interval ensuring member 10*m* does not rotate and maintains its posture. Therefore, the sealing member 10*g* and the interval ensuring member 10*m* do not rub against each other in a peripheral direction.

As shown in FIGS. 1 and 7, the longitudinal arrangement of the contact surface 10*m*1, which is an interval ensuring portion of the interval ensuring member 10*m* and which contacts the developing roller, is disposed at a location where it overlaps the developer sealing surface 10*g*1.

That is, the contact portion 10*p*1, serving as a maintaining portion, and the developer sealing surface 10*g*1, serving as a sealing section that suppresses (regulates) leakage of developer, are positioned in a plane that is orthogonal to the axial line 10*d*A of the developing roller 10*d* (cross section taken along arrows VI-VI shown in FIG. 7B).

The view (sectional view) taken along arrows VI-VI shown in FIG. 7B corresponds to FIG. 6. FIG. 6 shows that, in the cross section taken along arrows VI-VI, the interval ensuring member 10*m* is not provided at a side of the developing roller 10 that is opposite to the side where the contact surface 10*m*1 is disposed. That is, a space (region) U where the maintaining portion (contact surface 10*m*1) is not disposed along the developing roller 10*d* is disposed at the interval ensuring member 10*m*. The sealing member 10*g* (developer sealing surface 10*g*1) is disposed in the space U.

Therefore, part of the peripheral surface of the developing roller 10*d* directly faces the sealing member 10*g* (developer sealing surface 10*g*1) without the interval ensuring member 10*m* being interposed therebetween. That is, in the space U shown in FIG. 6, part of the peripheral surface of the developing roller 10*d* and the developer sealing surface 10*g*1 of the sealing member 10*g* directly contact each other.

As described above, the sealing member 10*g* may have a structure in which the sealing member 10*g* does not contact the developing roller 10*d* as shown in FIG. 8. Even in this case, if the interval ensuring member 10*m* according to the exemplary embodiment is used, there is nothing that blocks the space between the developing roller 10*d* and the developer sealing surface 10*g*1. The developing roller 10*d* and the developer sealing surface 10*g*1 may directly face each other (without interposing the interval ensuring member 10*m* therebetween).

In the structure shown in FIG. 6 or FIG. 8, since the function of the sealing member 10*g* is not impaired by the interval ensuring member 10*m*, the developer sealing surface 10*g*1 of the sealing member 10*g* can reliably suppress (regulate) leakage of developer.

Summarizing the above, in the exemplary embodiment, even if the developing roller 10*d* is rotated, the interval ensuring member 10*m* does not move in the rotation direction of the developing roller 10*d* (that is, the interval ensuring member 10*m* does not rotate).

In FIG. 6 (cross section taken along arrows VI-VI), the interval ensuring member 10*m* is such that the region (space) U for disposing the sealing member 10*g* is provided in the developing unit 10. The interval ensuring member 10*m* allows the sealing member 10*g* disposed in the space U to directly face the developing roller 10*d* (see FIGS. 6 and 8).

By these structures, in the exemplary embodiment, it is possible to place the interval ensuring member 10*m* and the sealing member 10*g* at positions where they overlap each other in the longitudinal direction thereof without limiting the functions of the sealing member 10*g*. That is, it is possible to dispose both the interval ensuring member 10*m* and the sealing member 10*g* in a predetermined cross section (cross section taken along arrows VI-VI; see FIG. 7B) that is orthogonal to the axial line 10*d*A of the developing roller 10*d*.

By disposing the interval ensuring member 10*m* and the sealing member 10*g* where they overlap each other in the longitudinal direction, as shown in FIG. 7, it is possible to shorten an existing developing device (FIG. 7A) in the longitudinal direction by a length equal to W on one side and by a length equal to W×2 on both sides of the existing developing device (FIG. 7A). As a result, each device (the developing unit, the process cartridge including the developing unit, and the image forming apparatus) can be made compact. In addition, the sealing member 10*g* can maintain its sealing effect with respect to developer while each device is made compact.

Here, the image forming apparatus according to the exemplary embodiment includes one process cartridge B, and forms a monochromatic image. However, the image forming apparatus may include a plurality of process cartridges and form an image of a plurality of colors (such as a two-color image, a three-color image, or a full-color image). The structures described in the exemplary embodiment may be applied to the process cartridge B and the developing unit (developing device) that are used in such image forming apparatuses. Alternatively, when a plurality of developing devices (developing cartridges) are provided for one photosensitive drum, the structure according to the exemplary embodiment may be applied to image forming apparatuses forming an image of a plurality of colors.

Although, in the exemplary embodiment, the case in which the developing device (developing unit) forms part of the process cartridge B is described, the cartridge may be one in which the developing device is attachable to and detachable from the image forming apparatus separately from the photosensitive drum. Alternatively, it is possible to provide an image forming apparatus with a developing device that cannot be attached and detached by a user.

Second Exemplary Embodiment

Next, a second exemplary embodiment is described. Structural features that are the same as those of the first exemplary embodiment are not described.

Figure 9:
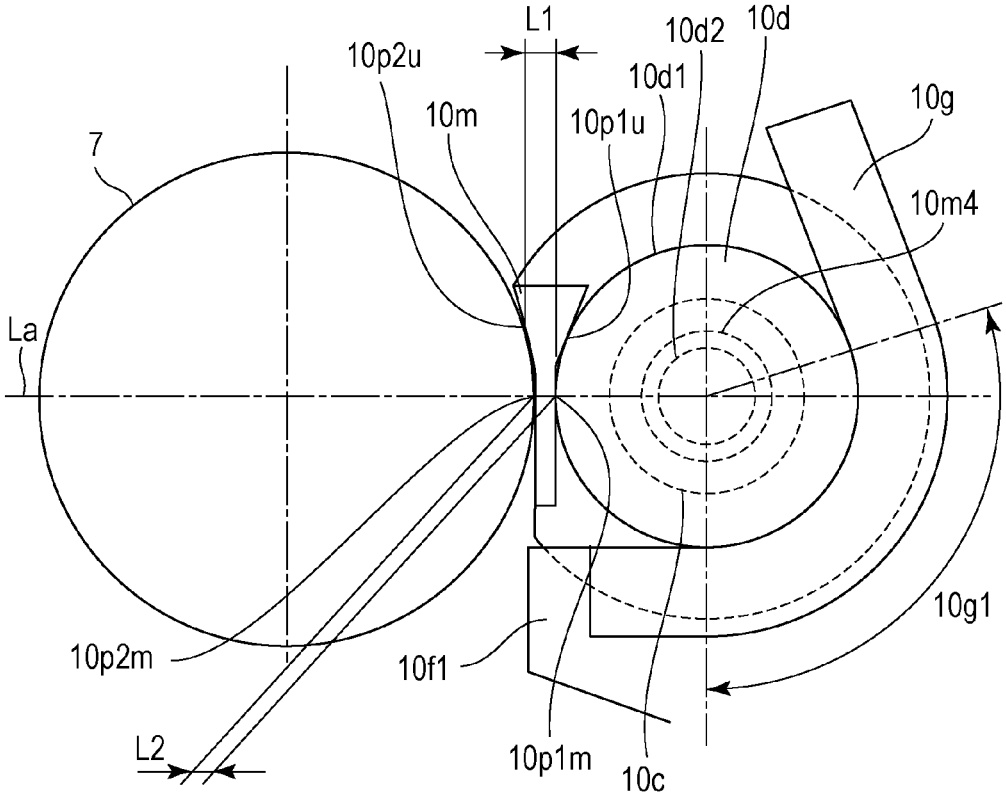
FIG. 9 is a sectional view of a structure of an interval ensuring member.

As shown in FIG. 9, the second exemplary embodiment differs from the first exemplary embodiment in that the shape in cross section (orthogonal to an axial line of a developing roller 10*d*) of an interval ensuring member 10*m* differs. Contact portions of the interval ensuring member 10*m* include contact portions 10*p*1*u* and 10*p*2*u* at two points situated upstream from a line La in a rotation direction X1 of the developing roller and contact portions 10*p*1*m* and 10*p*2*m* at two points existing on the line La. A longitudinal structure (arrangement in a longitudinal direction) and materials of the interval ensuring member 10*m* are equivalent to those in the first exemplary embodiment.

The contact portions 10*p*1*u* and 10*p*2*u* are movement regulating portions that prevent rotation of the interval ensuring member 10*m* (movement in directions of rotations of a photosensitive drum 7 and the developing roller 10*d*).

The contact portions 10$p$1$m$ and 10$p$2$m$ are maintaining portions that maintain the distance between the developing roller 10$d$ and the photosensitive drum 7 by contacting the developing roller 10$d$ and the photosensitive drum 7, respectively. That is, the contact portions 10$p$1$m$ and 10$p$2$m$ contact the developing roller 10$d$ and the photosensitive drum 7, respectively, where the developing roller 10$d$ and the photosensitive drum 7 are closest to each other. The distance (width) between the contact portion 10$p$1$m$ and the contact portion 10$p$2$m$ becomes the distance between the surface of the developing roller 10$d$ and the surface of the photosensitive drum 7.

Third Exemplary Embodiment

Figure 10:
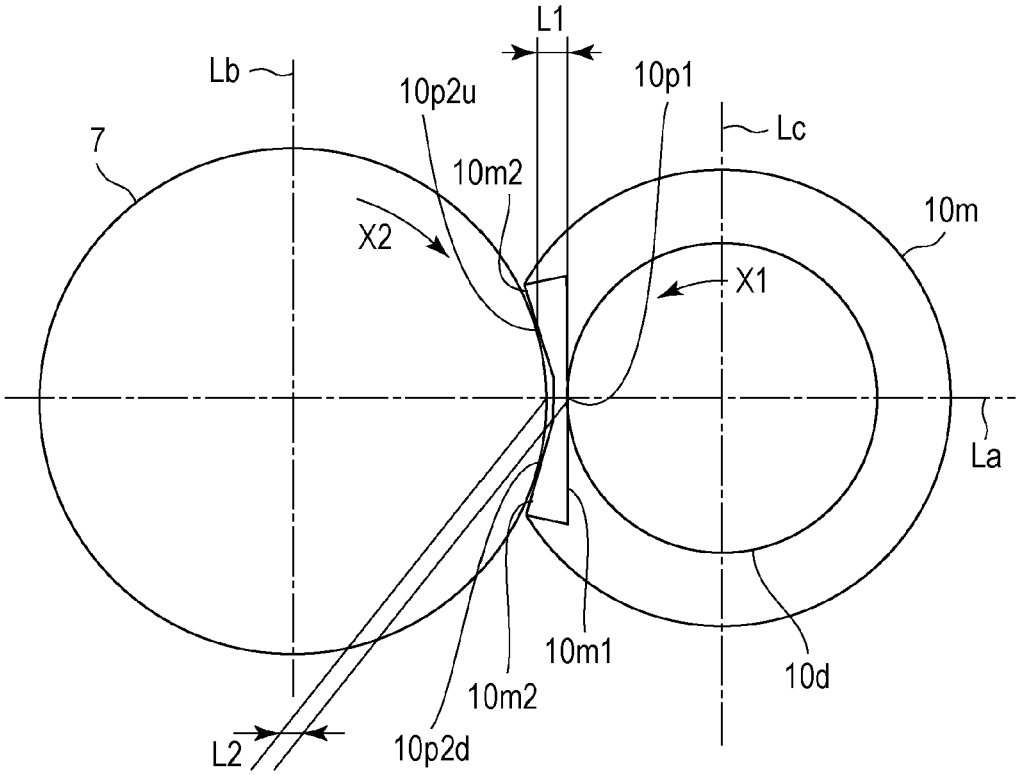
FIG. 10 is a sectional view of a structure of an interval ensuring member.

Next, a third exemplary embodiment is described. Structural features that are the same as those of the first exemplary embodiment are not described. As shown in FIG. 10, the third exemplary embodiment differs from the first exemplary embodiment in that the shape in cross section (that is orthogonal to an axial line of a developing roller 10$d$) of an interval ensuring member 10$m$ differs. The interval ensuring member 10$m$ includes contact portions 10$p$2$u$ and 10$p$2$d$ at two points situated upstream and downstream from a line La in a rotation direction X1 of the developing roller and a contact portion 10$p$1 at one point existing on the line La.

A longitudinal structure (arrangement in a longitudinal direction) and materials of the interval ensuring member 10$m$ are the same as those in the first exemplary embodiment.

The contact portions 10$p$2$d$ and 10$p$2$u$ that contact the photosensitive drum 7 and the contact portion 10$p$1 that contacts the developing roller 10$d$ form maintaining portions that maintain the distance between the photosensitive drum 7 and the developing roller 10$d$.

In the third exemplary embodiment, the contact portion 10$p$2$u$ that contacts the photosensitive drum 7 and the contact portion 10$p$1 that contacts the developing roller 10$d$ form movement regulating portions. This is due to the following two reasons. The first reason is that, of the contact portion 10$p$2$u$ and the contact portion 10$p$1, the contact portion 10$p$2$u$ contacts the photosensitive drum 7 at a location situated upstream from the line La. The second reason is that a distance L1 between the contact portion 10$p$2$u$ and the contact portion 10$p$1, which is measured parallel to the line La, is longer than a shortest distance between the surface of the developing roller 10$d$ and the surface of the photosensitive drum 7. Due to these two reasons, the contact portion 10$p$2$u$ and the contact portion 10$p$1 can prevent the interval ensuring member 10$m$ from moving in rotation directions of the photosensitive drum 7 and the developing roller 10$d$.

Although, in the third exemplary embodiment, the interval ensuring member 10$m$ contacts the photosensitive drum 7 at two points situated upstream and downstream from the line La in the rotation direction of the photosensitive drum 7, and contacts the developing roller at one point on the line La, this relationship may be reversed.

That is, the interval ensuring member 10$m$ may contact the developing roller 10$d$ at two points situated upstream and downstream from the line La in the rotation direction of the developing roller 10$d$, and contact the photosensitive drum 7 at one point.

Fourth Exemplary embodiment

In the above-described first to third exemplary embodiments, as a rotation preventing structure of the interval ensuring member 10$m$, the case in which L1>L2 is exemplified (see FIGS. 4, 9, and 10). Here, L1 is the width of the interval ensuring member 10$m$ (width of the movement regulating portion) that is measured parallel to the line La. L2 is the shortest distance between the photosensitive drum 7 and the developing roller 10$d$, that is, the distance between the surface of the photosensitive drum 7 and the surface of the developing roller 10$d$ that is measured on the line La. In other words, in the above-described first to third exemplary embodiments, the width L1 of the interval ensuring member 10$m$ is greater than the distance L2, at a location situated upstream from the line La in the rotation direction of the developing roller 10$d$ or the photosensitive drum 7.

The cross-sectional shapes of the interval ensuring members to which the present invention is applicable are not limited to those based on the aforementioned case. In exemplary embodiments below, interval ensuring members having cross-sectional shapes that are based on L1=L2 to which the present invention is applicable, that is, interval ensuring members not having the width L1 that is larger than L2 at a location situated upstream from the line La in the rotation direction of the developing roller 10$d$ or the photosensitive drum 7 are described.

First, a fourth exemplary embodiment is described. Structural features that are the same as those of the first exemplary embodiment are not described.

Figure 11:
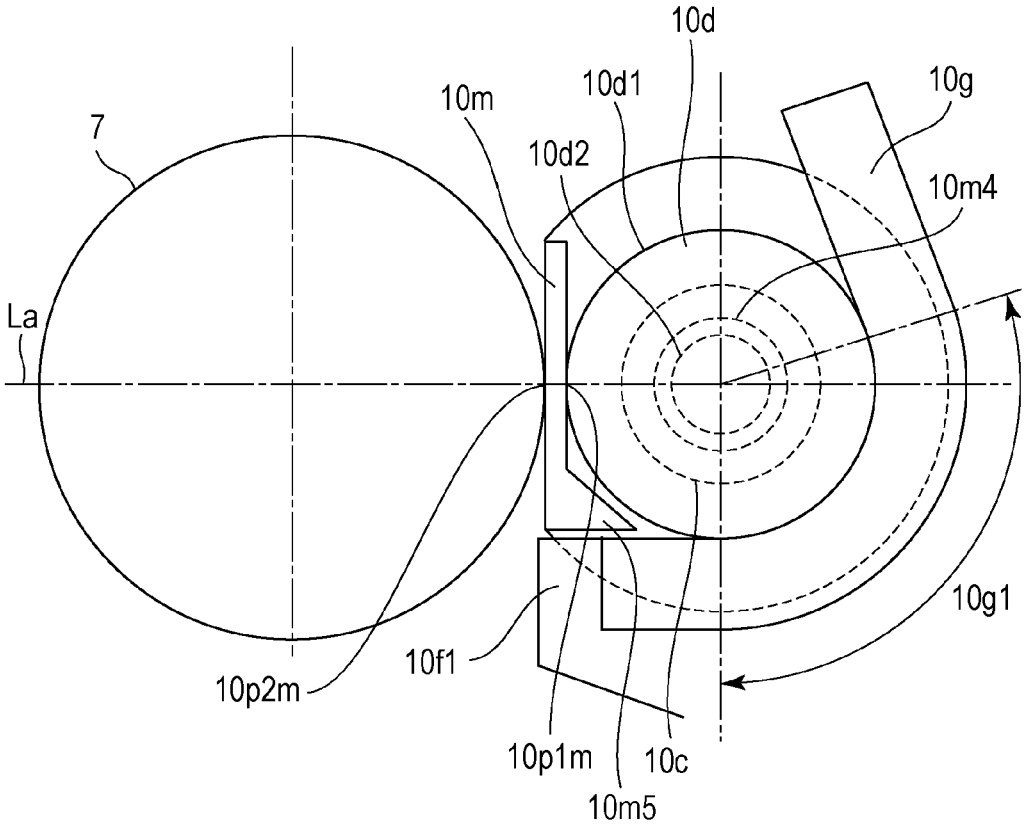
FIG. 11 is a sectional view of a structure of an interval ensuring member.

As shown in FIG. 11, the fourth exemplary embodiment differs from the first exemplary embodiment in that contact portions 10$p$1$m$ and 10$p$2$m$ are only provided at two points on a line La passing through closest portions of a photosensitive drum 7 and a developing roller 10$d$. Further, a contact portion 10$m$5, serving as a first movement regulating portion, that contacts a developing frame member 10$f$1 is provided at a downstream side of the developing roller 10$d$ in a rotation direction thereof. A longitudinal structure (arrangement in a longitudinal direction) of the interval ensuring member 10$m$ and materials are equivalent to those in the first exemplary embodiment, so that they are not described.

Next, a rotation prevention operation of the interval ensuring member 10$m$ is described. When the developing roller 10$d$ and the photosensitive drum 7 rotate, friction force is generated in the rotation direction of the developing roller by the developing roller 10$d$ and the contact portion 10$p$1 and by the photosensitive drum 7 and the contact portion 10$p$2.

The friction force generates a force that rotates the interval ensuring member 10$m$ in a rotation direction X1 of the developing roller 10$d$. However, it is possible to prevent the rotation of the interval ensuring member 10$m$ by bringing the contact portion 10$m$5 of the interval ensuring member 10$m$ into contact with the developing frame member 10$f$1 serving as a second movement regulating portion.

Fifth Exemplary Embodiment

Next, a fifth exemplary embodiment is described. Structural features that are the same as those of the first exemplary embodiment are not described. In this exemplary embodiment and a sixth exemplary embodiment described later, an interval ensuring member 10$m$ is prevented from moving in a rotation direction of a developing roller 10$d$ by securing (engaging or connecting) the interval ensuring member 10$m$ to a developing blade supporting plate 10$h$.

Figure 12:
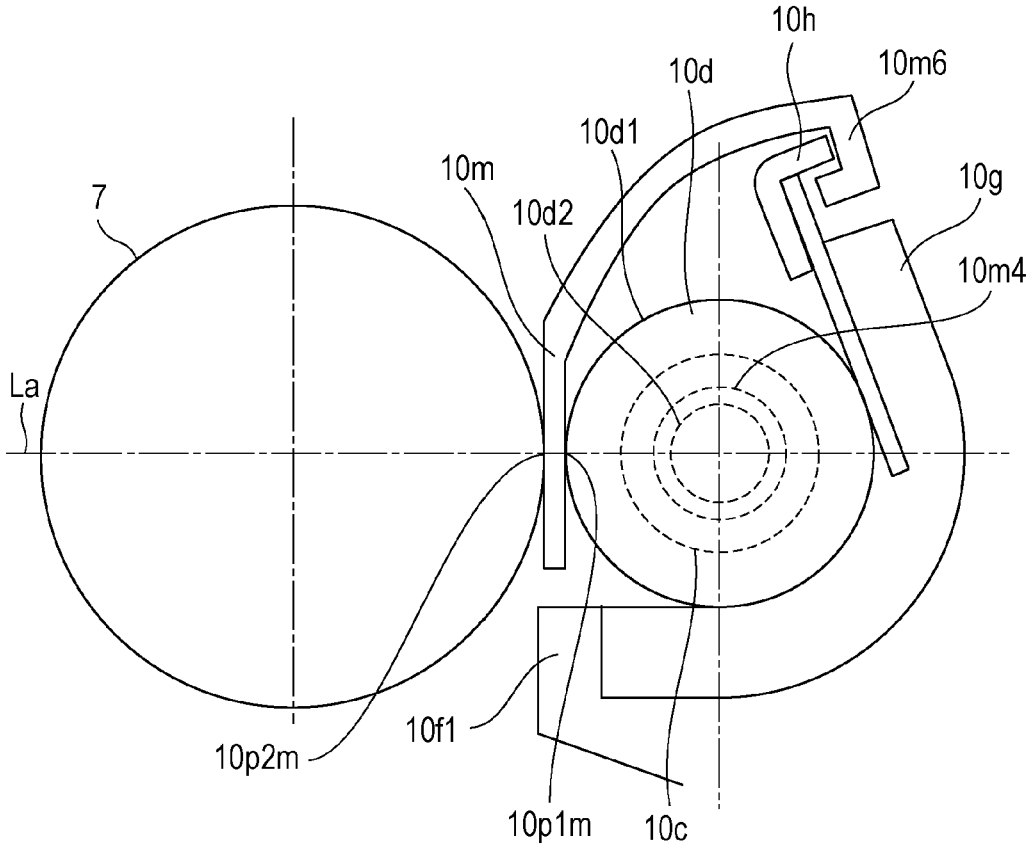
FIG. 12 is a sectional view of a structure of an interval ensuring member.

As shown in FIG. 12, the fifth exemplary embodiment differs from the first exemplary embodiment in that contact portions 10$p$1$m$ and 10$p$2$m$ are only provided at two points on a line La passing through closest portions of a photosensitive drum 7 and the developing roller 10$d$. In the fifth exemplary embodiment, a developing unit 10 is provided with the developing blade supporting plate 10*h* and an engaging portion 10*m*6, serving as a first movement regulating portion, at locations situated at an upstream side of the developing roller 10*d* in the rotation direction thereof. A longitudinal structure (arrangement in a longitudinal direction) of the interval ensuring member and materials are equivalent to those in the first exemplary embodiment, so that they are not described.

Next, a rotation prevention operation of the interval ensuring member 10*m* is described. As mentioned in the fourth exemplary embodiment, the interval ensuring member 10*m* receives a force that tries to rotate it in the rotation direction of the developing roller 10*d*. However, it is possible to prevent the rotation of the interval ensuring member 10*m* (that is, movement in the rotation direction of the developing roller 10*d*) by engaging an engaging portion 10*m*6 of the interval ensuring member 10*m* with the developing blade supporting plate 10*h* (serving as a second movement regulating portion).

Although, in the fifth exemplary embodiment, the engaging portion 10*m*6 engages with the developing blade supporting plate 10*h*, the engaging portion 10*m*6 may engage with something other than the developing blade supporting plate 10*h*. That is, the interval ensuring member 10*m* may engage with a developing frame member 10*f*1 (see FIG. 3), or a different member (that is, a member other than the developing blade supporting plate 10*h*) secured to the developing frame member 10*f*1. At this time, the engaging portion 10*m*6 may engage with, for example, the developing frame member 10*f*1 at a location situated upstream from the line La in the rotation direction of the developing roller 10*d*.

In the fifth exemplary embodiment, with the size of the interval ensuring member 10*m* being kept small, the interval ensuring member 10*m* is engaged with the developing blade supporting plate 10*h* that is disposed close to the developing roller 10*d*.

Sixth Exemplary Embodiment

Next, the sixth exemplary embodiment is described. Structural features that are the same as those of the first exemplary embodiment are not described.

Figure 13:
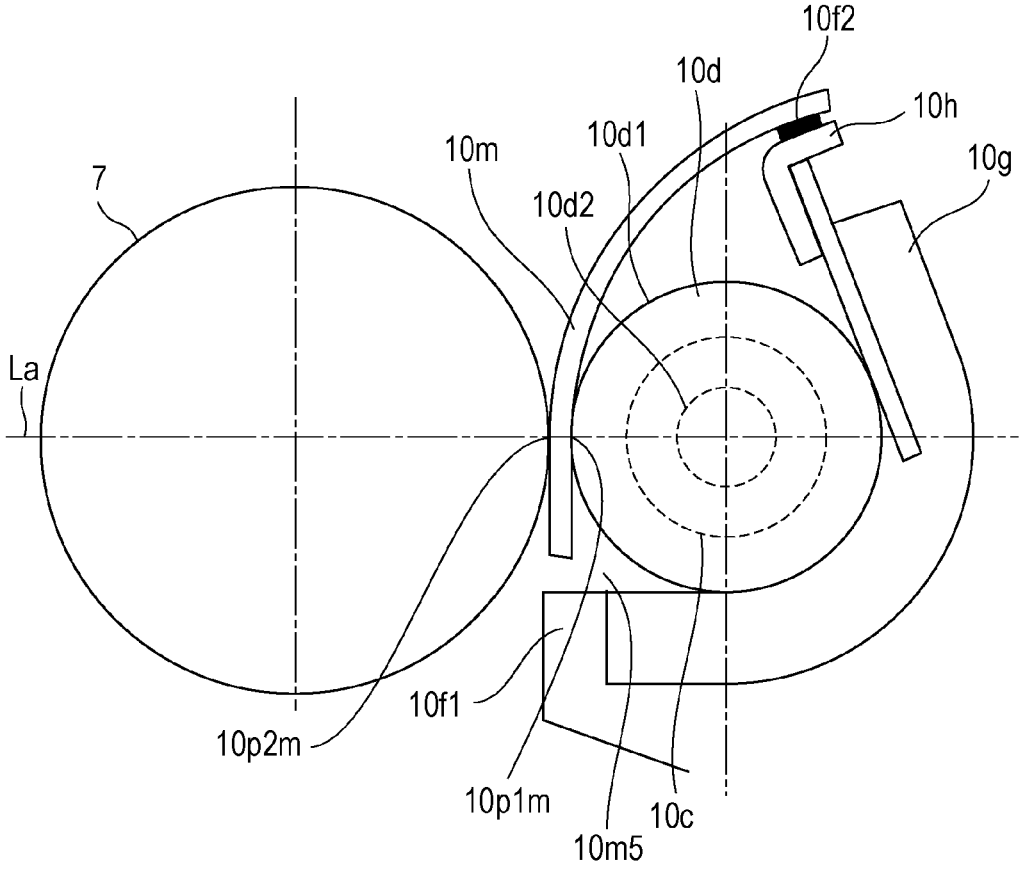
FIG. 13 is a sectional view of a structure of an interval ensuring member.

As shown in FIG. 13, contact portions 10*p*1*m* and 10*pm*2 are only provided at two points on a line La passing through closest portions of a photosensitive drum 7 and a developing roller 10*d*. Further, at an upstream side of the developing roller 10*d* in a rotation direction thereof, a developing blade supporting plate 10*h*, serving as a second movement regulating portion, and an interval ensuring member 10*m* are connected to each other using a connection portion 10*f*2, serving as a first movement regulating portion. The connection portion 10*f*2 is one that connects the developing blade supporting plate 10*h* and the interval ensuring member 10*m* by, for example, performing thermal welding, performing ultrasonic welding, using a two-sided adhesive tape, or using an adhesive. The connection portion 10*f*2 also positions the interval ensuring member 10*m* in a longitudinal direction thereof. That is, the connection portion 10*f*2 is a longitudinal movement regulating portion and prevents the interval ensuring member 10*m* from moving in a longitudinal direction of the developing roller 10*d*.

The interval ensuring member 10*m* is a sheet member formed of, for example, polyethylene terephthalate. Since, the other structural features are equivalent to those of the first exemplary embodiment, they are not described.

Even if the developing roller 10*d* is rotated, the connection portion 10*f*2 prevents the rotation of the interval ensuring member 10*m* (that is, movement in the rotation direction of the developing roller 10*d*).

Here, the movement regulating portion (connection portion 10*f*2) may be connected to a developing frame member 10*f*1 (see FIG. 3). That is, although, in the exemplary embodiment, the connection portion 10*f*2 connects the interval ensuring member 10*m* to the developing blade supporting plate 10*h*, the interval ensuring member 10*m* may be connected to something other than the developing blade supporting plate 10*h*. The interval ensuring member 10*m* may be connected to the developing frame member 10*f*1 or to a different member (other than the developing blade supporting plate 10*h*) secured to the developing frame member 10*f*1. Here, the connection portion 10*f*2 may connect, for example, the developing frame member f1 at a location situated upstream from a line La in the rotation direction of the developing roller 10*d*.

Seventh Exemplary Embodiment

Figure 14:
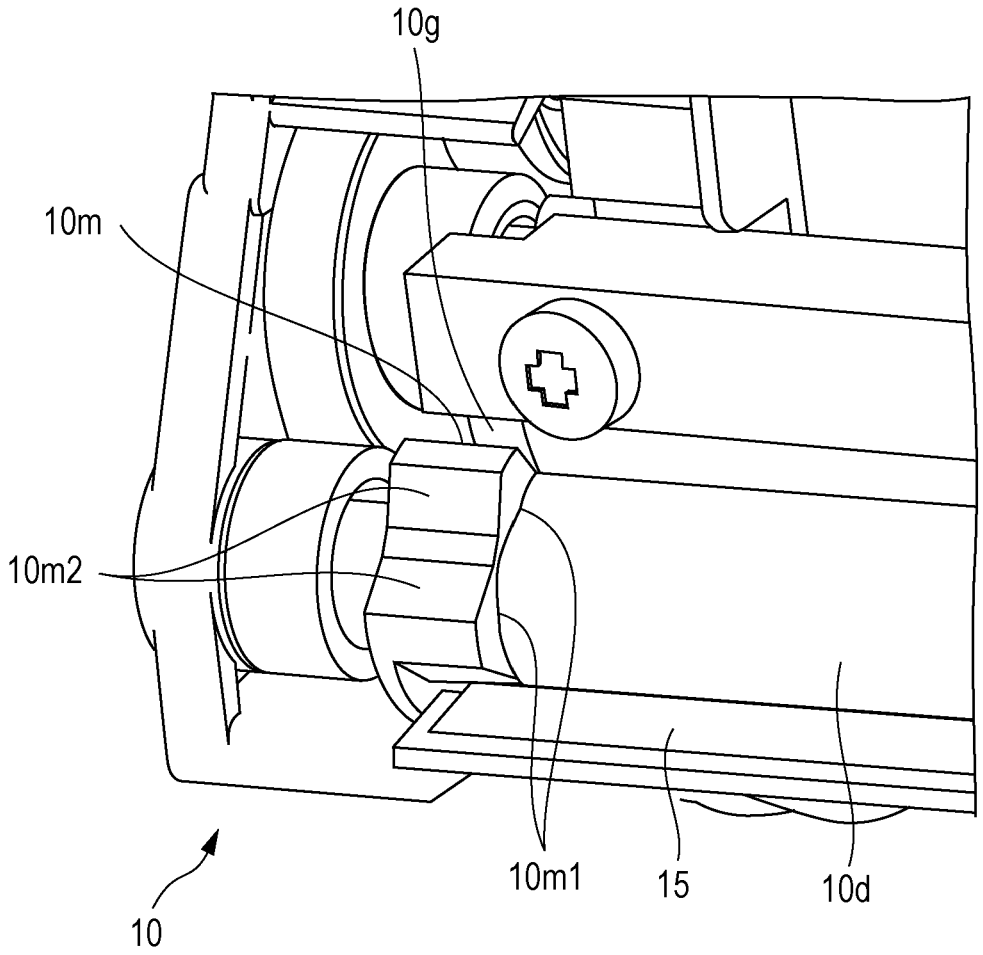
FIG. 14 is a sectional view of a structure of an interval ensuring member.

Next, a seventh exemplary embodiment is described with reference to FIGS. 14, 15, and 16. Structural features that are the same as those of the first exemplary embodiment are not described. FIG. 16A shows an existing structure. FIG. 16B shows an exemplary embodiment. The sectional view taken along arrows XV-XV (which is perpendicular to an axial line of a developing roller 10*d*) shown in FIG. 16B corresponds to FIG. 15. FIG. 14 is a perspective view of the exemplary embodiment.

Figure 15:
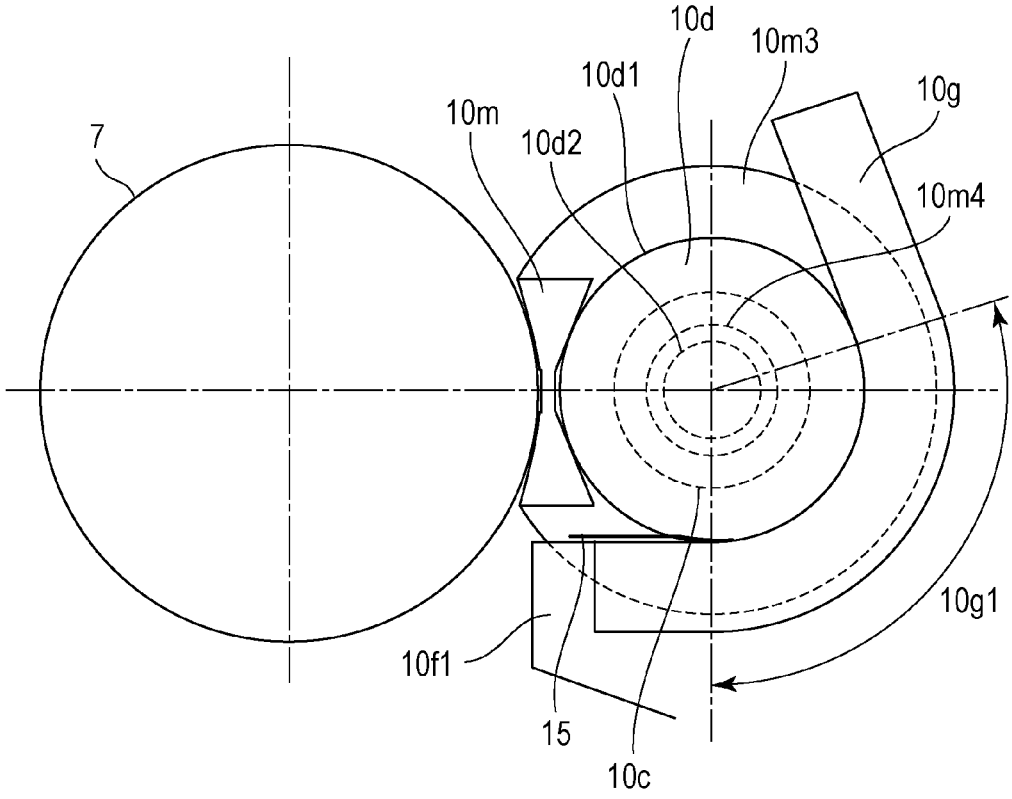
FIG. 15 is a sectional view of the structure of the interval ensuring member.
Figure 16A:
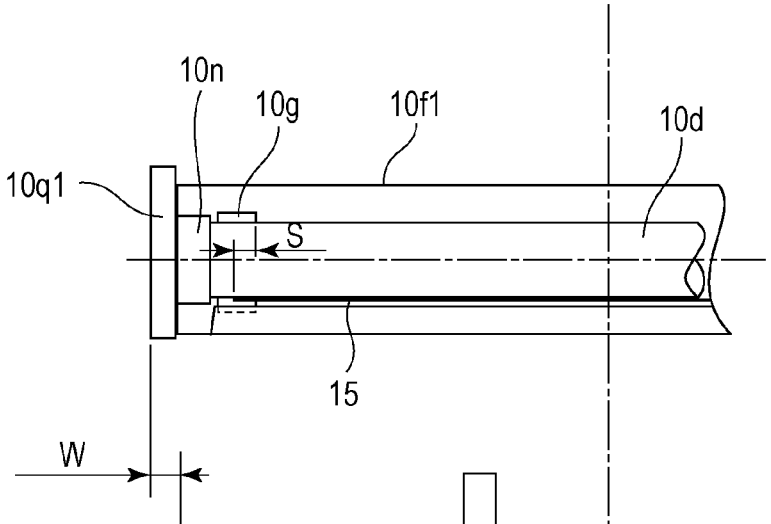
FIGS. 16A and 16B are explanatory views for comparing longitudinal dimensions in an exemplary embodiment and longitudinal dimensions in a related art.
Figure 16B:
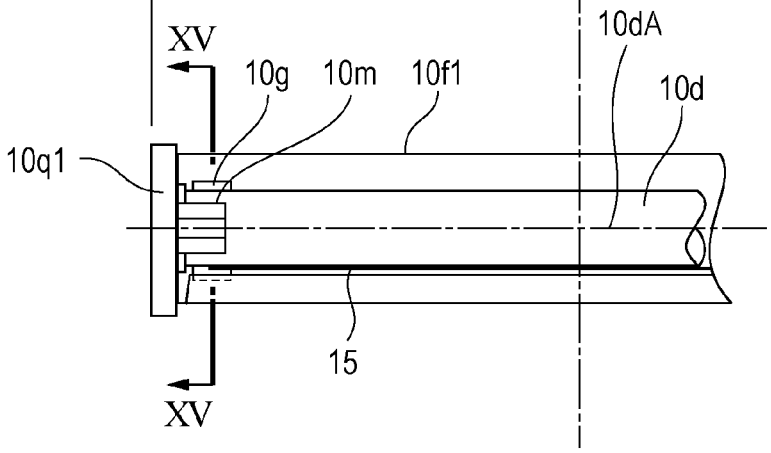

A structure of a sheet member 15 shown in FIGS. 14, 15, and 16 is described.

The material of the sheet member 15 is selectable from resin materials, such as polyethylene terephthalate and polyphenylene sulfide, as appropriate. The thickness thereof is selected as appropriate from the range of approximately 0.03 mm to 0.1 mm.

Next, as shown in FIG. 15, at a location situated downstream from closest portions of a developing roller 10*d* and a photosensitive drum 7 in a rotation direction of the developing roller 10*d*, the sheet member 15 is mounted on a developing frame member 10*f*1. As shown in FIGS. 14, 15, and 16B, the sheet member 15 contacts an outer peripheral surface of the developing roller 10*d* along a longitudinal direction of the developing roller 10*d*. Further, as shown in FIG. 16B, both end portions of the sheet member 15 in the longitudinal direction of the developing roller 10*d* are disposed so as to overlap the position of a sealing member 10*g* by a distance S in the longitudinal direction.

This structure makes it possible to prevent leakage of developer at the sheet member 15.

Here, as shown in FIGS. 15 and 16B, it is possible to dispose an interval ensuring member 10*m* according to the exemplary embodiment so as to overlap the sheet member 15 by mounting the sheet member 15 on the developing frame member 10*f*1. That is, in the longitudinal direction of the developing roller 10*d*, the interval ensuring member 10*m* overlaps at least part of the sheet member 15. FIG. 16B shows a state in which the interval ensuring member 10*m*, the sheet member 15, and the sealing member 10*g* are all positioned in cross section taken along arrows XV-XV orthogonal to an axial line of the developing roller 10*d*.

As in the first exemplary embodiment, this makes it to possible to shorten an existing developing device (FIG. 16A) by a length equal to W on one side and by a length equal to W×2 on both sides of the existing developing device (FIG. 16A). As a result, the device can be made compact.

The shapes of the interval ensuring members 10*m* according to the second to fifth exemplary embodiments are applicable to the sixth exemplary embodiment.

Finally, the advantages provided by each of the above-described exemplary embodiments are summarized as follows. That is, according to the structure of each of the exemplary embodiments, it is possible to provide a developing device, a process cartridge, and an image forming apparatus that can maintain a developer sealing effect by the sealing section and that can be made compact in an axial direction of the developer carrying member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-090802, filed Apr. 23, 2013, and No. 2014-069581, filed Mar. 28, 2014, which are hereby incorporated by reference herein in their entirety.

What is claimed is:

1. A developing device that is used in an image forming apparatus, the developing device comprising:

a developer carrying member that carries developer for developing a latent image on an image carrying member;

a frame member that supports the developer carrying member;

a sealing section that faces a peripheral surface of the developer carrying member and configured to suppress leakage of the developer from between an end portion of the developer carrying member and the frame member; and an interval ensuring member that maintains a distance between the image carrying member and the developer carrying member, wherein the interval ensuring member includes:

a movement regulating portion that prevents movement of the interval ensuring member in a rotation direction of the developer carrying member when the image carrying member and the developer carrying member rotate, and a maintaining portion that contacts the image carrying member and the developer carrying member for maintaining the distance between the image carrying member and the developer carrying member, and wherein the maintaining portion and the sealing section are positioned in a predetermined cross section that is orthogonal to an axial line of the developer carrying member.

2. The developing device according to claim 1, wherein the developing device further comprises a sheet member that regulates leakage of the developer from between the developer carrying member and the frame member by contacting the peripheral surface of the developer carrying member along an axial direction of the developer carrying member, and wherein the maintaining portion, the sealing section, and the sheet member are positioned in a predetermined cross section that is orthogonal to the axial line of the developer carrying member.

3. The developing device according to claim 1, wherein the movement regulating portion also serves as the maintaining portion.

4. The developing device according to claim 1, wherein two movement regulating portions are provided, the two movement regulating portions being two contact portions that contact the image carrying member and the developer carrying member, respectively, at least one of the two contact portions contacting the image carrying member or the developer carrying member at a location situated upstream in a rotation direction of the image carrying member or the rotation direction of the developer carrying member from a line connecting a rotation center of the image carrying member and a rotation center of the developer carrying member, and wherein, when a distance between the two contact portions is measured parallel to the line connecting the rotation center of the image carrying member and the rotation center of the developer carrying member, the distance between the two contact portions is longer than a shortest distance between a surface of the image carrying member and a surface of the developer carrying member.

5. The developing device according to claim 1, wherein the movement regulating portion contacts the frame member to prevent the movement of the interval ensuring member in the rotation direction of the developer carrying member.

6. The developing device according to claim 1, wherein the movement regulating portion is secured to the frame member or to a member that is secured to the frame member to prevent the movement of the interval ensuring member in the rotation direction of the developer carrying member.

7. The developing device according to claim 1, wherein the interval ensuring member includes a longitudinal regulating portion that prevents movement of the interval ensuring member in the axial direction of the developer carrying member.

8. The developing device according to claim 7, wherein the longitudinal regulating portion has a hole through which a shaft of the developer carrying member extends, and is prevented from moving by being interposed between the frame member and the developer carrying member.

9. The developing device according to claim 1, wherein the sealing section contacts the peripheral surface of the developer carrying member to regulate the leakage of the developer.

10. The developing device according to claim 1, wherein the sealing section is disposed so as not to contact the developer carrying member, and regulates the leakage of the developer by magnetic force.

11. The developing device according to claim 1, wherein the image carrying member and the developer carrying member rotate so that opposing surfaces thereof move in a same direction.

12. The developing device according to claim 1, wherein, in the cross section, the interval ensuring member allows the sealing section to face the developer carrying member without the interval ensuring member being interposed therebetween.

13. A developing device that is used in an image forming apparatus, the developing device comprising:

a developer carrying member that carries developer for developing a latent image on an image carrying member;

a frame member that supports the developer carrying member;

a sealing section that faces a peripheral surface of the developer carrying member and configured to regulate leakage of the developer from between an end portion of the developer carrying member and the frame member; and an interval ensuring member that is positioned between the image carrying member and the developer carrying member and that maintains a distance between the image carrying member and the developer carrying member, wherein the interval ensuring member is prevented from moving in a rotation direction of the developer carrying member, wherein the interval ensuring member and the sealing section are positioned in a predetermined cross section that is orthogonal to an axial line of the developer carrying member, and wherein a region that allows the sealing section to face the developer carrying member without the interval ensuring member being interposed therebetween is provided in the cross section.

14. A process cartridge that is attachable to and detachable from a main body of an image forming apparatus, the process cartridge comprising:

an image carrying member on which a latent image is formed;

a developer carrying member that carries developer for developing a latent image on the image carrying member;

a frame member that supports the developer carrying member;

a sealing section that faces a peripheral surface of the developer carrying member and configured to suppress leakage of the developer from between an end portion of the developer carrying member and the frame member; and an interval ensuring member that maintains a distance between the image carrying member and the developer carrying member, wherein the interval ensuring member includes:

a movement regulating portion that prevents movement of the interval ensuring member in a rotation direction of the developer carrying member when the image carrying member and the developer carrying member rotate, and a maintaining portion that contacts the image carrying member and the developer carrying member for maintaining the distance between the image carrying member and the developer carrying member, and wherein the maintaining portion and the sealing section are positioned in a predetermined cross section that is orthogonal to an axial line of the developer carrying member.

15. The process cartridge according to claim 14, wherein the process cartridge further comprises a sheet member that regulates leakage of the developer from between the developer carrying member and the frame member by contacting the peripheral surface of the developer carrying member along an axial direction of the developer carrying member, and wherein the interval ensuring member, the sealing section, and the sheet member are positioned in a predetermined cross section that is orthogonal to the axial line of the developer carrying member.

16. The process cartridge according to claim 14, wherein the movement regulating portion also serves as the maintaining portion.

17. The process cartridge according to claim 14, wherein two movement regulating portions are provided, the two movement regulating portions being two contact portions that contact the image carrying member and the developer carrying member, respectively, at least one of the two contact portions contacting the image carrying member or the developer carrying member at a location situated upstream in a rotation direction of the image carrying member or the rotation direction of the developer carrying member from a line connecting a rotation center of the image carrying member and a rotation center of the developer carrying member, and wherein, when a distance between the two contact portions is measured parallel to the line connecting the rotation center of the image carrying member and the rotation center of the developer carrying member, the distance between the two contact portions is longer than a shortest distance between a surface of the image carrying member and a surface of the developer carrying member.

18. The process cartridge according to claim 14, wherein the movement regulating portion contacts the frame member to prevent the movement of the interval ensuring member in the rotation direction of the developer carrying member.

19. The process cartridge according to claim 14, wherein the movement regulating portion is secured to the frame member or to a member that is secured to the frame member to prevent the movement of the interval ensuring member in the rotation direction of the developer carrying member.

20. The process cartridge according to claim 14, wherein the interval ensuring member includes a longitudinal regulating portion that prevents movement of the interval ensuring member in the axial direction of the developer carrying member.

21. The process cartridge according to claim 20, wherein the longitudinal regulating portion has a hole through which a shaft of the developer carrying member extends, and is prevented from moving by being interposed between the frame member and the developer carrying member.

22. The process cartridge according to claim 14, wherein the sealing section contacts the peripheral surface of the developer carrying member to regulate the leakage of the developer.

23. The process cartridge according to claim 14, wherein the sealing section is disposed so as not to contact the developer carrying member, and regulates the leakage of the developer by magnetic force.

24. The process cartridge according to claim 14, wherein the image carrying member and the developer carrying member rotate so that opposing surfaces thereof move in a same direction.

25. The process according to claim 14, wherein, in the cross section, the interval ensuring member allows the sealing section to face the developer carrying member without the interval ensuring member being interposed therebetween.

26. A process cartridge that is attachable to and detachable from a main body of an image forming apparatus, the process cartridge comprising:

an image carrying member on which a latent image is formed;

a developer carrying member that carries developer for developing a latent image on the image carrying member;

a frame member that supports the developer carrying member;

a sealing section that faces a peripheral surface of the developer carrying member and configured to regulate leakage of the developer from between an end portion of the developer carrying member and the frame member; and an interval ensuring member that is positioned between the image carrying member and the developer carrying member and that maintains a distance between the image carrying member and the developer carrying member, wherein the interval ensuring member is prevented from moving in a rotation direction of the developer carrying member, wherein the interval ensuring member and the sealing section are positioned in a predetermined cross section that is orthogonal to an axial line of the developer carrying member, and wherein a region that allows the sealing section to face the developer carrying member without the interval ensuring member being interposed therebetween is provided in the cross section.

27. An image forming apparatus that forms an image on a recording medium, the image forming apparatus comprising:

an image carrying member on which a latent image is formed;

a developer carrying member that carries developer for developing a latent image on the image carrying member;

a frame member that supports the developer carrying member;

a sealing section that faces a peripheral surface of the developer carrying member and configured to suppress leakage of the developer from between an end portion of the developer carrying member and the frame member;

an interval ensuring member that maintains a distance between the image carrying member and the developer carrying member; and a transport mechanism that transports the recording medium, wherein the interval ensuring member includes:

a movement regulating portion that prevents movement of the interval ensuring member in a rotation direction of the developer carrying member when the image carrying member and the developer carrying member rotate, and a maintaining portion that contacts the image carrying member and the developer carrying member for maintaining the distance between the image carrying member and the developer carrying member, and wherein the maintaining portion and the sealing section are positioned in a predetermined cross section that is orthogonal to an axial line of the developer carrying member.

* * * * *